United States Patent [19]

Langner

[11] Patent Number: 4,545,139

[45] Date of Patent: Oct. 8, 1985

[54] UNDER ICE PIPELAY APPARATUS AND METHOD

[75] Inventor: Carl G. Langner, Spring, Tex.

[73] Assignee: Shell Oil Company, Houston, Tex.

[21] Appl. No.: 676,744

[22] Filed: Nov. 30, 1984

[51] Int. Cl.[4] ..... E01H 4/00; E02F 3/90

[52] U.S. Cl. ..... 37/197; 37/72; 37/195; 405/174

[58] Field of Search ..... 37/72, 69, 197, 195; 405/154, 161, 174, 180–183

[56] References Cited

U.S. PATENT DOCUMENTS 969,172 9/1910 Lonney ..... 37/69

FOREIGN PATENT DOCUMENTS 1403852 5/1965 France ..... 37/72
302449 6/1971 U.S.S.R. ..... 405/174
546722 3/1977 U.S.S.R. ..... 37/72
616374 7/1978 U.S.S.R. ..... 37/72

*Primary Examiner*—E. H. Eickholt

[57] ABSTRACT

A construction machine with a cutter is provided to simultaneously cut a slot in an ice sheet, to excavate a trench in the underlying seabed, and to bottom-tow a pipeline in the trench formed by the cutter.

5 Claims, 1 Drawing Figure

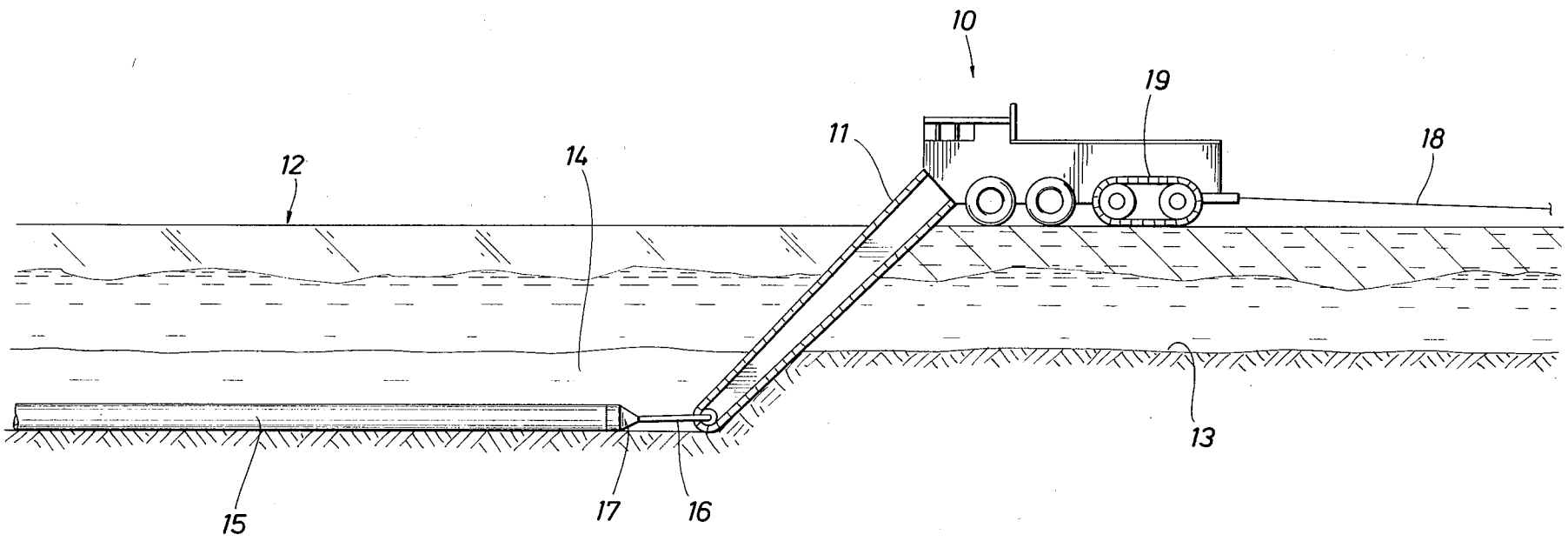
18
19
10
11
12
13
14
15
16
17

UNDER ICE PIPELAY APPARATUS AND METHOD

BACKGROUND OF THE INVENTION

Drilling by the oil industry in arctic offshore waters, typically from artificial gravel islands constructed to support such drilling activities, creates a need for pipelines from such drilling sites to transport oil and gas to production facilities onshore. Conventional pipeline construction techniques are extremely difficult to implement in the arctic offshore waters, due to the limited ice-free summer work period in arctic waters. Therefore, it is desirable to lay offshore pipelines during the winter time, using unconventional "through-the-ice" pipelaying techniques. Accordingly, pipelaying in the arctic during the winter necessitates cutting a long vertical slot in the ice sheet so that the pipeline may be laid through the ice slot and down to the sea bottom. In addition, a trench must be excavated in the sea bottom to accommodate and protect the pipeline from gouging and scouring effects of moving ice keels, etc. For ordinary trench-excavation techniques, the trench tends to fill in, especially in a sandy soil, and typically five to ten times as much soil must be excavated as in a vertical sidewall ditch. After the trench is dug, yet another operation is required to construct and lower the pipeline into the trench, meanwhile keeping the ice slot open and keeping the trench from filling in. All of these operations require considerable coordination, and failure in any one operation substantially increases construction time and cost.

Applicant is not aware of any prior art reference which, in his opinion as one skilled in the pipeline art, would anticipate or render obvious the novel method and apparatus of the present invention; however, for purposes of fully developing the background of the invention and establishing the state of the requisite art, the following U.S. patents are set forth: U.S. Pat. Nos. 3,950,955; 4,091,629; 4,409,747; 4,043,135.

SUMMARY OF THE INVENTION

The primary purpose of the present invention is to provide a method and apparatus for pipelaying in arctic offshore waters, which method and apparatus are economical in use and saving of construction time, and which overcomes many of the above-noted deficiencies of the prior art. Accordingly, the present invention provides a cutter for simultaneously cutting a slot in the floating ice sheet, for excavating a trench into the seabed beneath the ice sheet, and for placing a pipeline into the trench, comprising: a travelling cutter for simultaneously cutting a slot in the ice and excavating the trench; means for supporting the cutter and controlling its longitudinal movement from on top of the ice; and means connecting the cutter to the pipeline, whereby the cutter also functions to pull the pipeline into the trench as the trench is excavated. Preferably, the cutter supporting means are connected to external towing means, such as a tow cable attached to an ice anchor, which is capable of applying sufficient longitudinal force to the cutter to offset the cutting forces and the frictional drag of the pipeline in the trench.

The present invention additionally provides a method for excavating a trench into a seabed beneath a floating ice sheet and placing a pipeline in the trench, comprising: simultaneously cutting a slot in the ice and excavating the trench with a travelling cutter; supporting the cutter and controlling its longitudinal movement from on top of the ice; and pulling the pipeline in the trench with the cutter. In addition, the method preferably includes fluidizing the soil beneath the pipeline and applying a longitudinal force to the cutter supporting means by a tow cable connected to an ice anchor in order to overcome the pipeline tow friction.

Other purposes, distinctions over the art, advantages and features of the invention will be apparent to one skilled in the art upon review of the following:

BRIEF DESCRIPTION OF THE DRAWING

The FIGURE provides a sectional elevational view showing the ice cutting and trench excavation techniques of the present invention.

DESCRIPTION OF THE PREFERRED EMBODIMENTS

The present invention pertains to an apparatus and method for the simultaneous cutting of an ice slot, trenching and installation of a submarine pipeline. The apparatus includes, in a single unit, a travelling cutter for simultaneously cutting a slot in an ice sheet, for excavating a trench in the seabed beneath the ice sheet and for towing a pipeline into the trench. Thus, the present invention provides a special construction machine with a cutter to cut a slot in both the ice sheet and the seabed and to place a pipeline string, up to two miles long, in the trench as part of the trenching process. The free end of the pipeline is connected to the construction machine either by linkage at the end of the cutter or by other separate mechanisms. A winch built into the machine provides the necessary tow force to offset the pipeline frictional drag through a tow cable and distant ice anchor. Adjustable ballast tanks in the construction machine and speed-controlled caterpillar treads, or the like, at the rear may be needed to maintain hold-down pressure and to provide steady forward feed on the cutter.

As shown in the FIGURE, construction machine 10 having an attached cutting means 11, is adaptable to cutting through a floating ice sheet 12 and excavating into a seabed 13 both to form a slot in the ice sheet and to provide a trench 14 in the seabed. Simultaneously, a pipeline 15 is pulled along into the trench 14 by a connecting means 16 which extends from the pipeline to the cutter 11 near the bottom of the trench. The pipeline in the trench is preferably provided with fluidization means 17 in order to reduce tow friction. A tow cable 18 attached to an ice anchor (not shown) in combination with speed-controlled treads 19 facilitate moving the construction machine 10 along the floating ice sheet while simultaneously towing the pipeline 15 into the trench 14.

The foregoing description of the invention is merely intended to be explanatory hereof and various changes in the details of the described method and apparatus may be made within the scope of the appended claims without departing from the spirit of the invention.

What is claimed is:

1. A method for excavating a trench into a seabed beneath a floating ice sheet and for placing a pipeline in the trench, comprising:

simultaneously cutting a slot in the ice and excavating the trench with a travelling cutter;

supporting the cutter and controlling its longitudinal movement from on top of the ice; and pulling the pipeline in the trench with the cutter.

2. The method of claim 1 wherein the means of supporting the cutter on top of the ice is towed by a tow cable connected to an ice anchor.

3. The method of claim 1 including fluidizing the soil beneath the pipeline.

4. A trench cutter for excavating a trench into a seabed beneath a floating ice sheet and for placing a pipeline in the trench, comprising:

a travelling cutter for simultaneously cutting a slot in the ice and excavating the trench;

means on the ice for supporting the cutter and controlling its longitudinal movement; and means for connecting the cutter to the pipeline, whereby the cutter is functionable to pull the pipeline in the trench as the trench is excavated.

5. The trench cutter of claim 4 including tow means connected to the means for supporting the cutter.

* * * * *